US010173426B2

(12) United States Patent
Sasaki

(10) Patent No.: US 10,173,426 B2
(45) Date of Patent: Jan. 8, 2019

(54) LIQUID DROPLET DISCHARGE APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/667,331

(22) Filed: Aug. 2, 2017

(65) Prior Publication Data

US 2018/0043699 A1 Feb. 15, 2018

(30) Foreign Application Priority Data

Aug. 9, 2016 (JP) ..... 2016-156216

(51) Int. Cl.

| | |
|---|---|
| ***B41J 2/165*** | (2006.01) |
| ***B41J 2/045*** | (2006.01) |
| *B41J 2/01* | (2006.01) |
| *B41J 25/00* | (2006.01) |

(52) U.S. Cl.

CPC ..... *B41J 2/165* (2013.01); *B41J 2/0451* (2013.01); *B41J 2/16538* (2013.01); *B41J 2/16547* (2013.01); *B41J 2/16579* (2013.01); *B41J 2/01* (2013.01); *B41J 25/001* (2013.01)

(58) Field of Classification Search

CPC .... B41J 2/165; B41J 2/16547; B41J 2/16579; B41J 2/0451; B41J 2/01; B41J 25/001; B41J 2/16538

See application file for complete search history.

(56) References Cited

U.S. PATENT DOCUMENTS

| | | | | |
|---|---|---|---|---|
| 2006/0012656 | A1 | 1/2006 | Suzuki et al. | |
| 2008/0238982 | A1 | 10/2008 | Kaneko et al. | |
| 2008/0259118 | A1* | 10/2008 | Otsuka | B41J 2/16511 347/36 |
| 2009/0102874 | A1* | 4/2009 | Ito | B41J 11/0095 347/9 |
| 2010/0149582 | A1* | 6/2010 | Silverbrook | B41J 3/445 358/1.14 |
| 2013/0135484 | A1* | 5/2013 | Satoh | H04N 1/00278 348/207.2 |
| 2013/0265362 | A1* | 10/2013 | Toya | B41J 2/0451 347/19 |

FOREIGN PATENT DOCUMENTS

| | | | |
|---|---|---|---|
| JP | 2006-044226 | A | 2/2006 |
| JP | 2006-150873 | A | 6/2006 |

(Continued)

*Primary Examiner* — Yaovi M Ameh

(74) *Attorney, Agent, or Firm* — Workman Nydegger

(57) ABSTRACT

There is provided a printing apparatus (liquid droplet discharge apparatus) including a discharge portion that has a nozzle surface to which a nozzle that discharges ink on a medium is open, a reflecting mirror that reflects light, an imaging portion that images the reflecting mirror, a wiping portion that wipes the nozzle surface, and a movement mechanism that moves at least one out of the discharge portion, the reflecting mirror, and the imaging portion so as to switch a state of the nozzle between a state in which the nozzle surface faces the medium and a state in which the nozzle surface faces the imaging portion via the reflecting mirror.

4 Claims, 5 Drawing Sheets

(56) References Cited

FOREIGN PATENT DOCUMENTS

| | | | | | |
|---|---|---|---|---|---|
| JP | 2008-012880 | A | | 1/2008 | |
| JP | 2008-230190 | A | * | 10/2008 | ..... B41J 2/175 |
| JP | 2008-230190 | A | | 10/2008 | |
| JP | 2013-071292 | A | | 4/2013 | |
| JP | 2014-100791 | A | | 6/2014 | |
| JP | 2014-121810 | A | | 7/2014 | |
| JP | 2014-133425 | A | | 7/2014 | |

* cited by examiner

LIQUID DROPLET DISCHARGE APPARATUS

BACKGROUND

1. Technical Field

The present invention relates to a liquid droplet discharge apparatus such as an ink jet printer.

2. Related Art

A recording apparatus (printing apparatus) that performs printing by discharging ink, which is an example of liquid droplets, onto a medium from a nozzle that is formed on an ink jet head (discharge portion) is known in the related art as an example of a liquid droplet discharge apparatus. In such a recording apparatus, a discharge direction of ink may be changed by the ink that is discharged from the nozzle coming into contact with dried ink when the ink is dried in the vicinity of the nozzle of the ink jet head.

In this point, JP-A-2006-44226 discloses forming an ink repellent film on a discharge side front surface and wiping the discharge side front surface in order to suppress the ink from adhering to the discharge side front surface (nozzle surface) of the ink jet head.

However, there is a tendency for ink repellency of the ink repellent film that is formed on the discharge side front surface of the ink jet head to reduce accompanying an increase of the number of times of wiping regardless of quality of scratch resistance of the ink repellent film. Accordingly, in such a recording apparatus, it is desired to not perform wiping when the wiping of the discharge side front surface is not necessary in order to lengthen the life of the ink jet head. As an example, there is a possibility that wiping is performed regardless of the ink not adhering to the discharge side front surface in a case where wiping is regularly performed, and there is a concern that wiping is performed when the wiping of the discharge side front surface is not necessary.

Note that, such a circumstance is not limited to a recording apparatus that performs printing by discharging ink on a medium, and is generally common even in a liquid droplet discharge apparatus that discharges liquid droplets on the medium.

SUMMARY

An advantage of some aspects of the invention is to provide a liquid droplet discharge apparatus that is able to suppress wiping of a nozzle surface of a discharge portion when wiping of the nozzle surface is not necessary.

Hereinafter, means of the invention and operation effects thereof will be described.

According to an aspect of the invention, there is provided a liquid droplet discharge apparatus including a discharge portion that has a nozzle surface to which a nozzle that discharges liquid droplets on a medium is open, a reflecting mirror that reflects light, an imaging portion that images the reflecting mirror, a wiping portion that wipes the nozzle surface, and a movement mechanism that moves at least one out of the discharge portion, the reflecting mirror, and the imaging portion to switch between a first state in which the nozzle surface faces the medium and a second state in which the nozzle surface faces the imaging portion via the reflecting mirror.

According to the configuration described above, the nozzle surface comes to be in the first state of facing the medium using the movement mechanism in a case where the discharge portion discharges liquid droplets towards the medium. Meanwhile, the nozzle surface comes to be in the second state of facing the imaging portion via the reflecting mirror using the movement mechanism in a case where the imaging portion images the nozzle surface via the reflecting mirror. In this manner, since it is possible to switch a state of the nozzle between a state in which the discharge portion discharges liquid droplets toward the medium and a state in which the imaging portion images the nozzle surface via the reflecting mirror, the imaging portion and the reflecting mirror tend not to hinder discharge of liquid droplets by the discharge portion when the discharge portion discharges liquid droplets toward the medium. In addition, it is possible to evaluate the state of the nozzle surface based on an image of the nozzle surface that is imaged by the imaging portion. As a result, since it is possible to wipe the nozzle surface in a case where the nozzle surface is soiled by mist and the like of liquid droplets, it is possible to suppress wiping of the nozzle surface when it is not necessary to wipe the nozzle surface of the discharge portion.

Preferably, the liquid droplet discharge apparatus is provided with an air blowing portion that blows air toward the reflecting mirror.

When foreign matter such as mist or fragments of the medium that is generated when liquid droplets are discharged from the nozzle of the discharge portion adheres to the reflecting mirror, it is not possible to accurately evaluate the state of the nozzle surface since the imaging portion images the nozzle surface to which foreign matter is adhered. In this point, according to the configuration described above, it is possible to suppress adherence of foreign matter as described above to the reflecting mirror since the air blowing portion blows air on the reflecting mirror. Accordingly, it is possible to accurately evaluate according to the state of the nozzle surface since foreign matter is suppressed from being mirrored in the image of the nozzle surface that is imaged by the imaging portion.

In the liquid droplet discharge apparatus, preferably the reflecting mirror is a concave mirror or a convex mirror.

In a case where the reflecting mirror is the concave mirror, it is possible for the imaging portion to image the nozzle surface in further detail since it is possible to enlarge and mirror the nozzle surface. Therefore, it is possible to accurately evaluate according to the state of the nozzle surface. In addition, in a case where the reflecting mirror is the convex mirror, it is possible to reduce the size of the reflecting mirror since it is possible to mirror a wide range of the nozzle surface. Therefore, it is possible to reduce a region for disposing the reflecting mirror.

Preferably the liquid droplet discharge apparatus is provided with a support portion that supports the medium onto which liquid droplets are discharged from the discharge portion and a carriage that moves in a scanning direction in a state in which the discharge portion and the imaging portion are supported, the support portion and the reflecting mirror are disposed lined up in the scanning direction, and the movement mechanism switches between the first state and the second state by moving the carriage in the scanning direction.

According to the configuration described above, the state is switched from the first state of the nozzle surface facing the medium to the second state of the nozzle surface facing the imaging portion via the reflecting mirror by moving the carriage from a side at which the reflecting mirror is not disposed to a side at which the reflecting mirror is disposed. That is, it is possible to efficiently switch a state of the nozzle between the first state and the second state since switching between the first state and the second state is possible by only moving the carriage in the scanning direction.

In the liquid droplet discharge apparatus, preferably the imaging portion is supported in the carriage such that the imaging portion faces the support portion when the nozzle surface is in the first state, and a control portion is provided that determines whether or not wiping of the nozzle surface is performed based on an image of the nozzle surface that is obtained by imaging the nozzle surface via the reflecting mirror and an image of a liquid droplet discharge surface that is obtained by the imaging portion imaging the medium onto which liquid droplets are discharged.

According to the configuration described above, it is possible to determine whether or not deviation occurs at a landing position of the liquid droplets that are discharged from the nozzle toward the medium based on the image of the liquid droplet discharge surface while determining whether or not the nozzle surface is soiled based on the image of the nozzle surface. That is, it is possible to determine with good precision whether or not wiping of the nozzle surface is performed based on two determination results. For example, it is possible to reduce the necessary number of times of wiping of the nozzle surface if wiping of the nozzle surface is performed limited to a case where the nozzle surface is soiled and a case where deviation occurs at a landing position of the liquid droplets that are discharged from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment in which the liquid droplet discharge apparatus is embodied as a printing apparatus will be described below with reference to the drawings. Note that, the printing apparatus of the present embodiment is an ink jet printer that performs printing by discharging ink as an example of the liquid droplets on a medium M such as a paper sheet.

Figure 1:
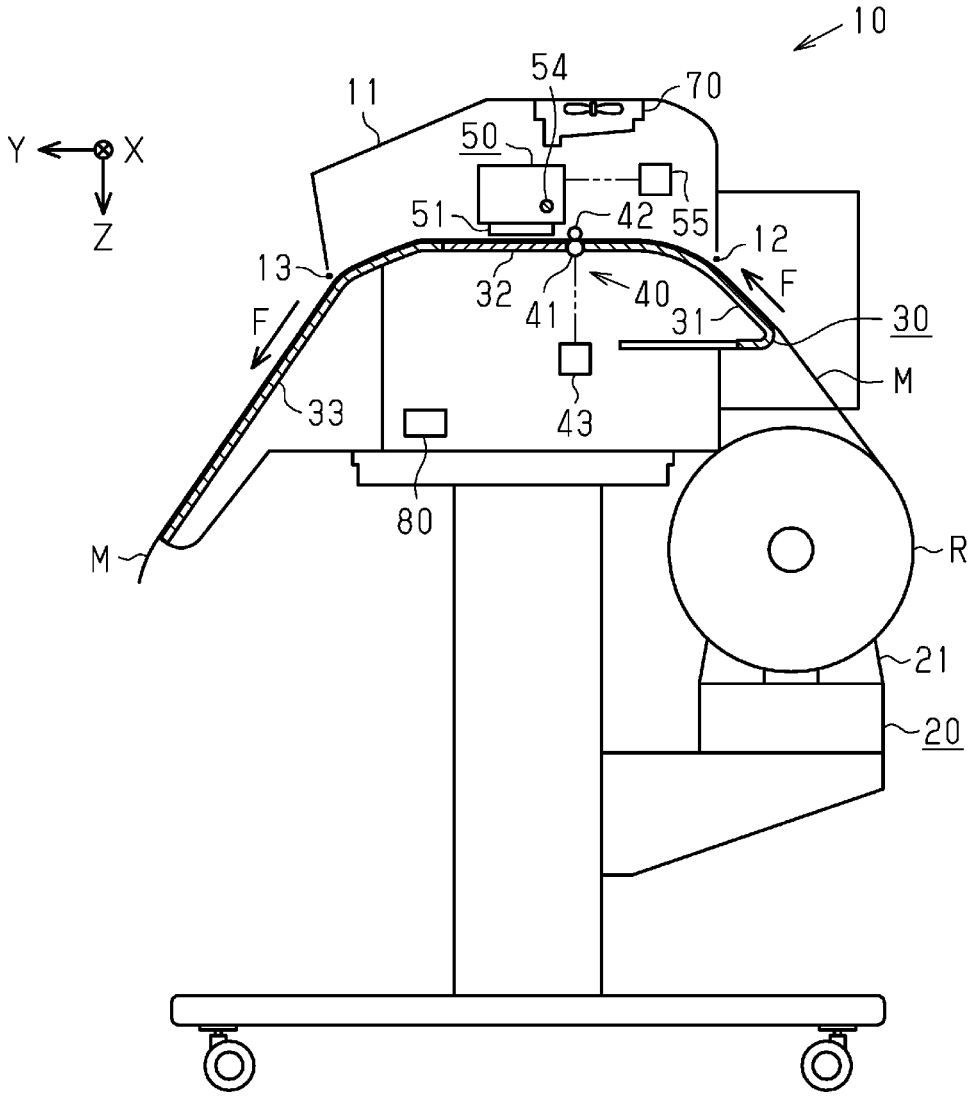
FIG. 1 is a side view of a printing apparatus according to an embodiment.

As shown in FIG. 1, the printing apparatus 10 is provided with a feeding portion 20 that feeds the medium M, a guiding portion 30 that guides the medium M, a transport portion 40 that transports the medium M, a printing portion 50 that performs printing on the medium M, a maintenance portion 60 that maintains the printing portion 50 (refer to FIG. 2), an air blowing portion 70 that blows air toward the printing portion 50, and a control portion 80 that controls the configurations.

Note that, hereinafter in the description, a width direction of the printing apparatus 10 is a "scanning direction X", a depth direction of the printing apparatus 10 is a "front and back direction Y", a height direction of the printing apparatus 10 is a "vertical direction Z", and a direction in which the medium M is transported is a "transport direction F". The scanning direction X, the front and back direction Y, and the vertical direction Z are directions that intersect with (are orthogonal to) each other, and the transport direction F is a direction that intersects with (is orthogonal to) the scanning direction X. In addition, one end (right end in FIG. 2) in the scanning direction X is a first end X1 and another end (left end in FIG. 2) in the scanning direction X is a second end X2.

The feeding portion 20 has a holding member 21 which rotably holds a roll body R on which the medium M is wound. The holding member 21 holds the medium M with a different type or the roll body R with a different dimensions in the scanning direction X. Then, the feeding portion 20 feeds out the medium M that is unwound from the roll body R toward the guiding portion 30 by rotating the roll body R in one direction (counterclockwise direction in FIG. 1).

The guiding portion 30 is provided with a first guiding portion 31, a second guiding portion 32, and third guiding portion 33 that constitute a transport path of the medium M from a transport direction upstream toward a transport direction downstream. The first guiding portion 31 guides the medium M that is fed out from the feeding portion 20 toward the second guiding portion 32, the second guiding portion 32 supports the medium M on which printing is performed, and the third guiding portion 33 guides the printed medium M toward the transport direction downstream. In the embodiment, in such a point, the second guiding portion 32 is equivalent to an example of a "support portion".

As shown in FIG. 1, the transport portion 40 is provided with a transport roller 41 that applies transport force to the medium M, a driven roller 42 that presses the medium M on the transport roller 41, and a rotation mechanism 43 that rotates and drives the transport roller 41. The transport roller 41 and the driven roller 42 are rollers for which the scanning direction X is set as an axial direction. In addition, the transport roller 41 is disposed vertically below the transport path of the medium M, and the driven roller 42 is disposed vertically above the transport path of the medium M. Then, in the transport portion 40, the medium M is transported in the transport direction F by rotating the transport roller 41 in a state in which the medium M is interposed by the transport roller 41 and the driven roller 42.

Figure 2:
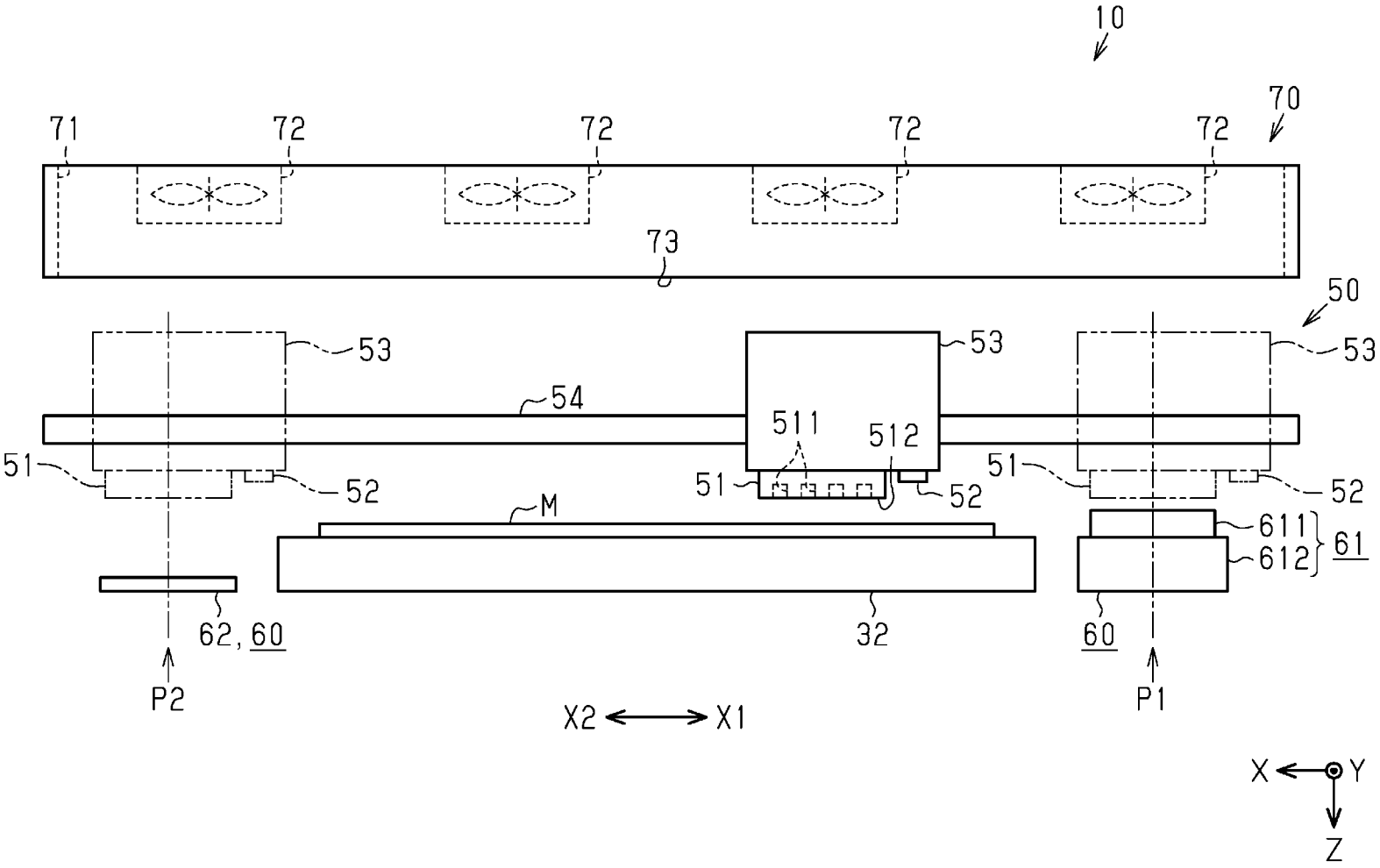
FIG. 2 is a front surface view of the inside of a casing of the printing apparatus.

As shown in FIGS. 1 and 2, the printing portion 50 is provided with a discharge portion 51 that discharges ink toward the medium M, an imaging portion 52 that images the medium M and the like, and a carriage 53 that moves in the scanning direction X in a state in which the discharge portion 51 and the imaging portion 52 are supported. In addition, the printing portion 50 is provided with a guide shaft 54 that supports the carriage 53 to be movable in the scanning direction X, and a movement mechanism 55 that is a driving source when the carriage 53 is moved in the scanning direction X.

Figure 3:
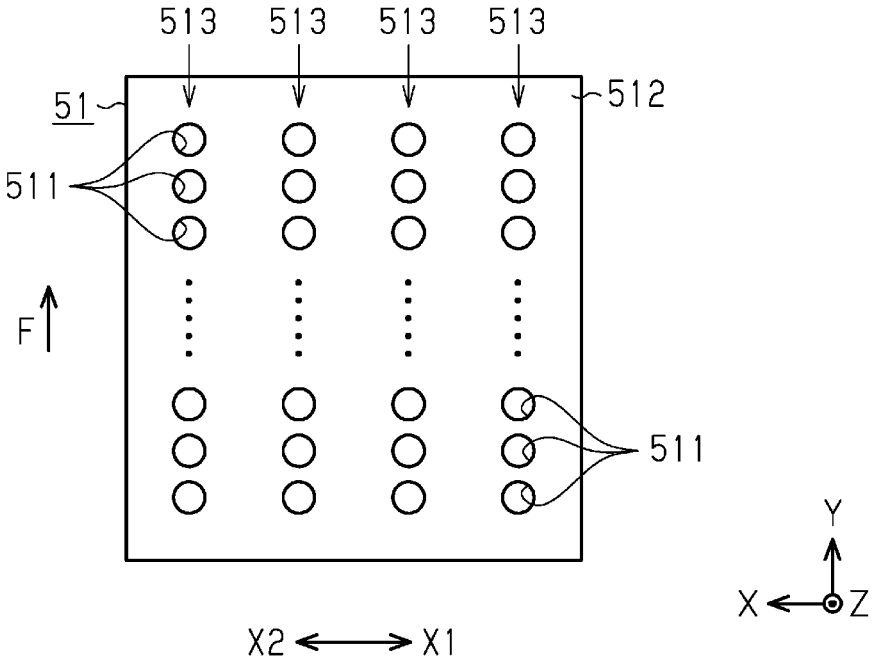
FIG. 3 is a bottom surface view of a discharge portion of the printing apparatus.

As shown in FIGS. 2 and 3, the discharge portion 51 has a nozzle surface 512 that is open to a plurality of nozzles 511. Preferably an ink repellent film is formed on the nozzle surface 512 in order to suppress adherence of ink. For example, the ink repellent film may be formed using a fluorine-based compound or a silicone-based compound.

In addition, a plurality (four rows in the embodiment) of nozzle rows 513 consisting of a plurality of nozzles 511 lined up in the transport direction F is formed on the nozzle surface 512 along the transport direction F. The plurality of nozzle rows 513 are provided lined up with gaps in the scanning direction X. In addition, for example, the plurality of nozzle rows 513 may be constituted by a nozzle row that consists of a plurality of nozzles 511 that discharge cyan ink, a nozzle row that consists of a plurality of nozzles 511 that discharge magenta ink, a nozzle row that consists of a plurality of nozzles 511 that discharge yellow ink, and a nozzle row that consists of a plurality of nozzles 511 that discharge black ink.

Figure 4:
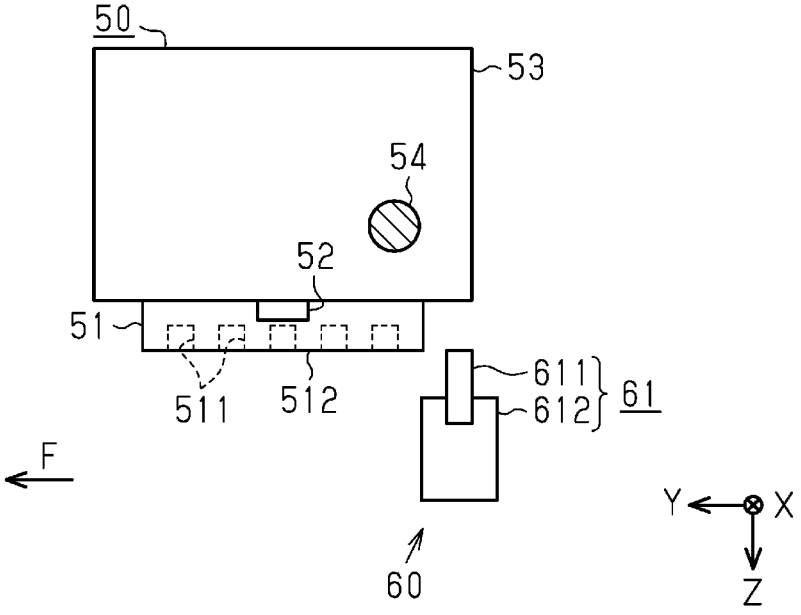
FIG. 4 is a side view of a printing portion and a maintenance portion of the printing apparatus.

As shown in FIGS. 2 and 4, the carriage 53 is an approximately rectangular box shape. The carriage 53 supports the discharge portion 51 and the imaging portion 52 below the carriage 53 vertically downward. As shown in FIG. 2, the carriage 53 supports the imaging portion 52 on a first end X1 side and supports the discharge portion 51 on a second end X2 side in the scanning direction X. Therefore, the discharge portion 51 and the imaging portion 52 that are supported in the carriage 53 face the second guiding portion 32 in a case where the carriage 53 is positioned vertically above the second guiding portion 32. Note that, an orientation of the discharge portion 51 is a direction in which the liquid droplets that are discharged from the nozzles 511 of the discharge portion 51 and an orientation of the imaging portion 52 is an imaging direction.

The imaging portion 52 may be a so-called digital camera and preferably has an autofocus function. In addition, preferably the imaging portion 52 has a resolution at which it is possible to image ink droplets that are discharged on the medium M in order to be able to image the ink droplets that are discharged from the discharge portion 51 toward the medium M. Furthermore, preferably the imaging portion 52 is able to image a region that is longer than a length of a nozzle row 513 in at least the transport direction F.

In the movement mechanism 55, rotary motion of a motor and the like may be a mechanism that is replaceable in reciprocal movement in the scanning direction X of the carriage 53. For example, the movement mechanism 55 may be realized by disposing a pair of pulleys at the first end X1 and the second end X2 in the scanning direction X and rotating and driving one pulley using a motor in a state in which a belt that is wound around the pair of pulleys is connected to the carriage.

As shown in FIG. 2, the maintenance portion 60 is provided with a wiping mechanism 61 that is disposed lined up with the second guiding portion 32 at the first end X1 side of the second guiding portion 32 and a reflecting mirror 62 that is disposed lined up with the second guiding portion 32 at the second end X2 side of the second guiding portion 32 in the scanning direction X. Here, a position of the carriage 53 is referred to as a "first position P1" when the discharge portion 51 and the wiping mechanism 61 that are supported in the carriage 53 face each other and a position of the carriage 53 is referred to as a "second position P2" when the discharge portion 51 and the reflecting mirror 62 that are supported in the carriage 53 face each other. Note that, a part of the discharge portion 51 may face the reflecting mirror 62 when the carriage 53 is positioned at the second position P2. In other words, the second position P2 is a region in which the carriage 53 is positioned when the discharge portion 51 faces the reflecting mirror 62.

As shown in FIG. 4, the wiping mechanism 61 has a wiping portion 611 that consists of elastically deformable rubber or resin material and a holding portion 612 that holds the wiping portion 611. The wiping portion 611 is a so-called wiper blade. In addition, the holding portion 612 is configured to be reciprocally movable in a formation direction (transport direction F) of the nozzle row 513 in the discharge portion 51 in a state in which the wiping portion 611 is supported. Then, in the wiping mechanism 61, the holding portion 612 is moved in the transport direction F when the carriage 53 is positioned at the first position P1. In this manner, in the wiping mechanism 61, the nozzle surface 512 is wiped in the wiping portion 611 by the nozzle surface 512 of the discharge portion 51 and the wiping portion 611 being in sliding contact.

The reflecting mirror 62 has a configuration in which the imaging portion 52 images the nozzle surface 512 of the discharge portion 51 via the reflecting mirror 62 when the carriage 53 is disposed at the second position P2. Therefore, in the reflecting mirror 62, preferably the length in at least the transport direction F is more than or equal to the length of the nozzle row 513, and the reflecting mirror 62 is disposed in a state in which the reflection surface that reflects light faces the movement region of the carriage 53. Note that, for example, the reflecting mirror 62 may be formed by metal being coated on the front surface of a glass and being subjected to metal plating.

In addition, the reflecting mirror 62 may be a planar mirror, may be a convex mirror, and may be a concave mirror. For example, it is possible to mirror a wide range in a case where the reflecting mirror 62 is a convex mirror in comparison to a case of being a planar mirror. In addition, it is possible to expand and mirror a narrow range in a case where the reflecting mirror 62 is a concave mirror in comparison to a case of being a planar mirror. Note that, preferably the imaging portion 52 is disposed outside of a focus point of the concave mirror in a case where the reflecting mirror 62 is a concave mirror. In addition, preferably the distance between the imaging portion 52 and the reflecting mirror 62 is close, and the reflecting mirror 62 is a convex mirror in a case where the imaging portion 52 is disposed inside the focus point of the concave mirror when the reflecting mirror 62 is a concave mirror.

As shown in FIG. 2, the air blowing portion 70 has a duct 71 that links a space within the casing 11 and a space outside of the casing 11, and an air blowing fan 72 that is provided inside the duct 71. The duct 71 is provided across the scanning direction X of the printing apparatus 10. The length of the duct 71 in the scanning direction X and the sum of the length of the second guiding portion 32 and the length of the maintenance portion 60 in the scanning direction X are approximately equal. In addition, the duct 71 has an air blowing port 73 that is open toward the second guiding portion 32 and the maintenance portion 60. A plurality of the air blowing fans 72 are disposed lined up in the scanning direction X.

Then, in the air blowing portion 70, air that is taken in from the outside of the casing 11 is blown inside the casing 11 by driving the air blowing fan 72. Thereby, air is blown towards the second guiding portion 32 and the maintenance portion 60, and foreign matter such as ink mist or paper powder that floats inside the casing 11 is discharged outside the casing 11 via an inlet 12 of the medium M or a discharge port 13 of the medium M.

Next, a control configuration of the printing apparatus 10 in the embodiment will be described.

The imaging portion 52 is connected to an input side interface of the control portion 80, and the transport portion 40, the printing portion 50 (discharge portion 51 and movement mechanism 55), the wiping mechanism 61, and the air blowing portion 70 (air blowing fan 72) are connected to an output side interface of the control portion 80.

Then, the control portion 80 performs a transport operation in which the medium M is transported by a unit transport amount in the transport direction F by controlling the driving of the transport portion 40. In addition, the control portion 80 moves the carriage 53 in the scanning direction X by controlling driving of the printing portion 50, and performs a discharge operation in which ink is discharged from the discharge portion 51 toward the medium M that is supported in the second guiding portion 32. Then, the control portion 80 performs printing on the medium M by alternately performing the transport operation and the discharge operation.

Note that, in the embodiment, ink is discharged from the discharge portion 51 in a case where the carriage 53 is moved in the scanning direction X from the first end X1 to the second end X2, then unidirectional printing is performed in which ink is not discharged from the discharge portion 51 in a case where the carriage 53 is moved in the scanning direction X from the second end X2 to the first end X1.

In addition, in a case where the control portion 80 discharges ink from the discharge portion 51 toward the medium M while moving the carriage 53 from the first end X1 to the second end X2, the control portion 80 images the front surface (printing surface) of the medium M on which ink is discharged in the imaging portion 52 and acquires an image of the printing surface (hereinafter "image Img1 of the printing surface"). In addition, the control portion 80 continues movement of the carriage 53 even after the discharge portion 51 does not face the medium M that is supported in the second guiding portion 32 and positions the carriage 53 at the second position P2. Then, the control portion 80 images the nozzle surface 512 of the discharge portion 51 that is mirrored in the reflecting mirror 62 in the imaging portion 52 and acquires an image of the nozzle surface 512 (hereinafter "image Img2 of the nozzle surface 512").

In such a point, the imaging portion 52 of the embodiment may be configured to image the medium M and the reflecting mirror 62 that are supported in the second guiding portion 32. In addition, in the embodiment, a "first state" in which the nozzle surface 512 faces the medium M and a "second state" in which the nozzle surface 512 faces the imaging portion 52 via the reflecting mirror 62 are switched between by the movement mechanism 55 moving the carriage 53 that supports the discharge portion 51 and the imaging portion 52. In other words, the first state and the second state are switched between by the movement mechanism 55 relatively moving the discharge portion 51 and the imaging portion 52 with respect to the reflecting mirror 62 disposed to be fixed inside the casing 11.

Note that, the printing surface of the embodiment is an ink discharge surface on which ink is discharged in the medium M, and is equivalent to an example of a "liquid droplet discharge surface". In addition, the second state in which the nozzle surface 512 faces the imaging portion 52 via the reflecting mirror 62 refers to a state in which light that is emitted from the nozzle surface 512 is incident on an imager such as a CCD or CMOS of the imaging portion 52 that is reflected by the reflecting mirror 62.

Further, in a case where printing is performed by the printing apparatus 10, ink that is adhered to the nozzle surface 512 of the discharge portion 51 may be thickened (solidified) and dust, fluff, or paper powder (fragments of the medium M) may be adhered to the nozzle surface 512.

Then, in a case where foreign matter blocks a part of an opening of the nozzle 511 by the foreign matter such as thickened ink or dust being adhered to the nozzle surface 512, the discharge direction of the ink may be changed by the ink that is discharged from the nozzle 511 coming into contact with the foreign matter. That is, deviation may occur at a landing position of ink droplets and printing quality may reduce due to deficient discharge of ink by the nozzle 511. Therefore, in a case where foreign matter adheres in the vicinity of the nozzle 511, preferably the nozzle surface 512 is wiped in order to remove foreign matter that is adhered to the nozzle surface 512.

Meanwhile, in a case where foreign matter is adhered at a position that is separated from the nozzle 511 by the foreign matter adhering to the nozzle surface 512, the ink that is discharged from the nozzle 511 does not come into contact with foreign matter and deficient discharge of ink by the nozzle 511 tends not to occur. That is, in a case where foreign matter does not adhere to the vicinity of the nozzle 511 since printing quality does not reduce, preferably the nozzle surface 512 is not wiped in order to suppress an increase of printing interruption time accompanying wiping of the nozzle surface 512 and depletion of a ink repellent film of the nozzle surface 512.

Therefore, in the embodiment, the control portion 80 determines whether or not deficient discharge of ink occurs in the discharge portion 51 based on the image Img1 of the printing surface and the image Img2 of the nozzle surface 512.

Next, a method for determining necessity of wiping of the nozzle surface 512 will be described based on the image Img1 of the printing surface with reference to FIGS. 5 and 6. Note that, FIG. 5 indicates an example of the image Img1 of the printing surface when ink is normally discharged from a plurality of nozzles 511 that constitute the nozzle row 513, and FIG. 6 indicates an example of the image Img1 of the printing surface when ink is not normally discharged from the plurality of nozzles 511 that constitute the nozzle row 513.

Figure 5:
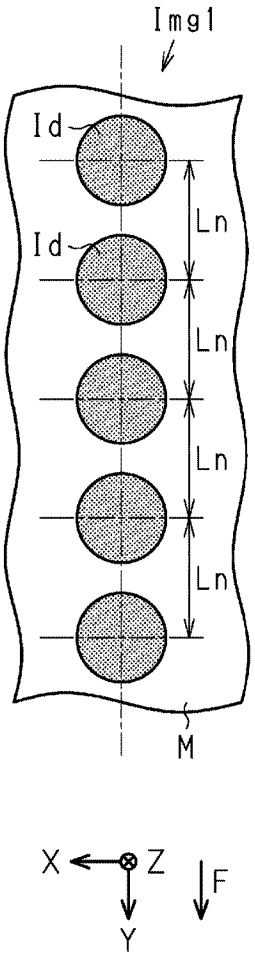
FIG. 5 is an enlarged planar view of a medium to which deviation does not occur at a landing position of ink.
Figure 6:
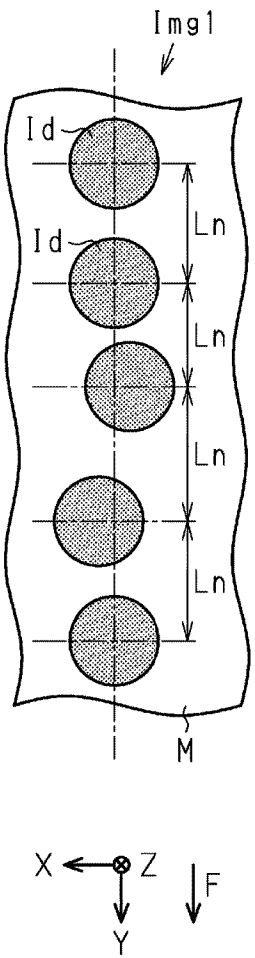
FIG. 6 is an enlarged planar view of a medium to which deviation occurs at a landing position of ink.

As shown in FIG. 5, there is a low degree of necessity to wipe the nozzle surface 512 since deviation does not occur at the landing position of ink droplets Id that are discharged from the nozzle 511 in a case where a distance between centers Ln of the ink droplets Id adjacent in the transport direction F is fixed and in a case where the center of the ink droplets Id is aligned in the transport direction F in the image Img1 of the printing surface. Meanwhile, as shown in FIG. 6, there is a high degree of necessity to wipe the nozzle surface 512 since deviation occurs at the landing position of the ink droplets Id that are discharged from the nozzle 511 in a case where a distance between centers Ln of the ink droplets Id adjacent in the transport direction F is fixed or in a case where the center of the ink droplets Id is not aligned in the transport direction F in the image Img1 of the printing surface.

Therefore, in the embodiment, the control portion 80 determines the necessity of wiping of the nozzle surface 512 by determining whether or not deviation occurs at the landing position of the ink droplets Id based on the image Img1 of the imaged printing surface. In addition, hereinafter in the description, determining whether or not deviation occurs at the landing position of the ink droplets Id based on the image Img1 of the imaged printing surface is referred to as "first determination".

Next, a method for determining necessity of wiping of the nozzle surface 512 will be described based on the image Img2 of the nozzle surface 512 with reference to FIGS. 7 and 8. Note that, FIG. 7 indicates an example of the image Img2 of the nozzle surface 512 on which foreign matter is not adhered in the vicinity of the nozzle 511, and FIG. 8 indicates an example of the image Img2 of the nozzle surface 512 on which foreign matter is adhered in the vicinity of the nozzle 511.

Figure 7:
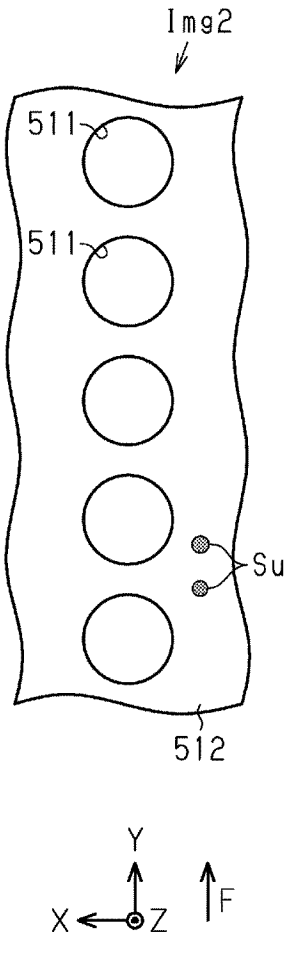
FIG. 7 is an enlarged bottom surface view of the discharge portion to which foreign matter is not adhered in the vicinity of a nozzle.
Figure 8:
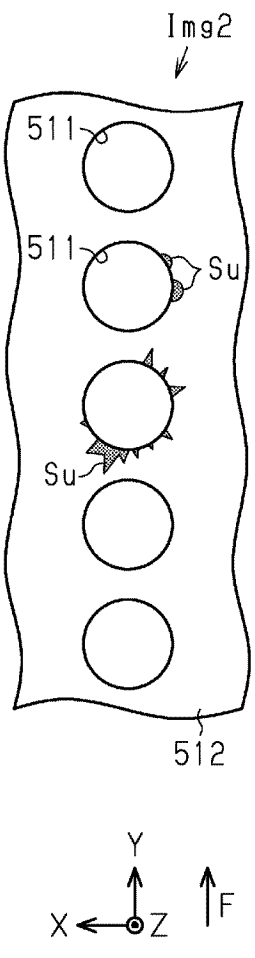
FIG. 8 is an enlarged bottom surface view of the discharge portion to which foreign matter is adhered in the vicinity of the nozzle.

As shown in FIG. 7, there is a low degree of necessity for wiping the nozzle surface 512 in a case where foreign matter Su is not adhered in the vicinity of the nozzle 511 that is, to an opening edge of the nozzle 511 in the image Img2 of the nozzle surface 512. In detail, there is a low degree of necessity for wiping the nozzle surface 512 in a case where foreign matter Su is not adhered to an opening edge of the nozzle 511 even in a case where foreign matter Su is adhered at a position that is separated from the opening edge of the nozzle 511. Thereby, foreign matter Su that is adhered at a position that is separated from the opening edge of the nozzle 511 does not hinder flight of ink that is discharged from the nozzle 511. Meanwhile, as shown in FIG. 8, there is a high degree of necessity for wiping the nozzle surface 512 in a case where foreign matter Su in adhered to an opening edge of the nozzle 511 in the image Img2 of the nozzle surface 512. Thereby, it is possible for foreign matter Su that is adhered to the opening edge of the nozzle 511 to hinder flight of ink that is discharged from the nozzle 511.

Therefore, in the embodiment, the control portion 80 determines the necessity for wiping the nozzle surface 512 by determining whether or not foreign matter Su is adhered to the opening edge of the nozzle 511 based on the image Img2 of the imaged nozzle surface 512. In addition, hereinafter in the description, determining whether or not deviation occurs at the landing position of the ink droplets Id with respect to the medium M based on the image Img2 of the nozzle surface 512 is referred to as "second determination".

Note that, determination of whether or not foreign matter Su is adhered to the opening edge of the nozzle 511 (first determination) and determination of whether or not deviation occurs at the landing position of the ink droplets Id with respect to the medium M (second determination) may be performed as comparison of an image that is currently imaged and a normal image. For example, comparison of the image that is currently imaged and the normal image may utilize a known algorithm that extracts a feature point or feature quantity within the images.

Next, a process which is executed when the control portion 80 determines the necessity of wiping of the nozzle surface 512 will be described with reference to a flow chart indicated in FIG. 9. Note that, the process is a process in which the carriage 53 is moved from the first end X1 to the second end X2, and is executed such that the discharge operation is started in which ink is discharged from the discharge portion 51 toward the medium M.

Figure 9:
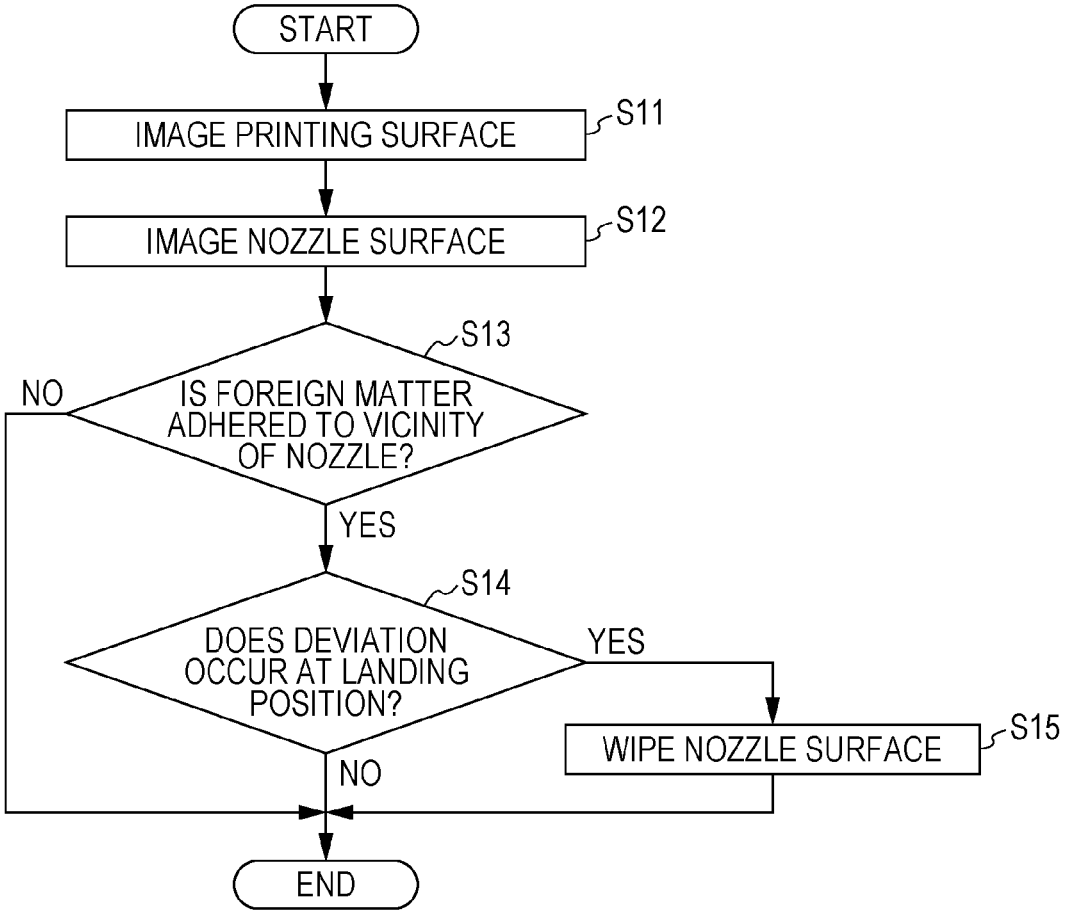
FIG. 9 is a flow chart illustrating the flow of a process that a control portion executes when it is determined whether or not a nozzle surface of the discharge portion is wiped.

As shown in FIG. 9, the control portion 80 images the image Img1 of the printing surface in the imaging portion 52 while the discharge operation is performed, in other words, when in the first state in which the nozzle surface 512 faces the medium M that is supported in the second guiding portion 32 (step S11). In the embodiment, it is possible to image a circumstance of the ink droplets Id that are discharged on the medium M during the discharge operation when the carriage 53 moves from the first end X1 to the second end X2 since the discharge portion 51 is disposed on the first end X1 side of the carriage 53 and the imaging portion 52 is disposed on the second end X2 side of the carriage 53.

Next, the control portion 80 sets the second state in which the nozzle surface 512 faces the imaging portion 52 via the reflecting mirror 62 by continuing movement of the carriage 53 from the first end X1 to the second end X2 even after the discharge operation has ended, and images the nozzle surface 512 of the discharge portion 51 via the reflecting mirror 62 in the imaging portion 52 (step S12). Note that, in a case where it is not possible to image the image that accommodates all nozzles 511 that are open to the nozzle surface 512 in one imaging pass, the control portion 80 again images the nozzle surface 512 of the discharge portion 51 that is mirrored on the reflecting mirror 62 in the imaging portion 52 after adjusting the position of the carriage 53 in the scanning direction X. Note that, in the embodiment, the carriage 53 is disposed at the second position P2 when in the second state in which the nozzle surface 512 faces the imaging portion 52 via the reflecting mirror 62.

Then, the control portion 80 determines whether or not foreign matter is adhered to the opening edge of the nozzle 511 (step S13) based on the image Img2 of the nozzle surface 512 imaged in step S12, and temporarily stops the process when foreign matter is not adhered to the opening edge of the nozzle 511 (step S13: NO). That is, this case is a case where foreign matter is not adhered to the opening edge of the nozzle 511 and therefore it is determined that it is not necessary to wipe the nozzle surface 512.

Meanwhile, in a case where foreign matter adheres to the opening edge of the nozzle 511 (step S13: YES), the control portion 80 determines whether or not deviation occurs at the landing position of the ink droplets Id with respect to the medium M (step S14) based on the image Img1 of the printing surface imaged in step S11, and temporarily stops the process when deviation does not occur at the landing position (step S14: NO).

That is, this case is a case where there is no influence on the discharge state of ink even if foreign matter is adhered to the opening edge of the nozzle 511 and therefore it is determined that it is not necessary to wipe the nozzle surface 512. For example, foreign matter may not adhere such that a part of the opening of the nozzle 511 is blocked even if the foreign matter adheres to the opening edge of the nozzle 511.

In addition, in a case where deviation occurs at the landing position of the ink droplets Id with respect to the medium M (step S14), the control portion 80 wipes the nozzle surface 512 in the wiping mechanism 61 after moving the carriage 53 to the first position P1 (step S15). That is, this case is a case where foreign matter is adhered to the opening edge of the nozzle 511 and there is influence on the discharge state of ink, and therefore it is determined that it is necessary to wipe the nozzle surface 512. After that, the control portion 80 temporarily stops the process.

As described above, in the embodiment, the nozzle surface 512 is only wiped in a case where a determination result of both of the first determination based on the image Img1 of the printing surface and the second determination based on the image Img2 of the nozzle surface 512 results in there being a nozzle 511 in which there is deficient discharge of ink. Therefore, the number of times of wiping of the nozzle surface 512 is small in comparison with a case where it is determined whether or not the nozzle surface 512 is wiped based on only the second determination.

Next, actions of the printing apparatus 10 of the embodiment will be described.

In a case where printing is performed on the medium M in the printing apparatus 10, the transport operation which transports the medium M in the transport direction F and the discharge operation which discharges ink from the discharge portion 51 toward the medium M while moving the carriage 53 from the first end X1 to the second end X2 are alternately performed. Then, in the discharge operation, the imaging portion 52 images the front surface of the medium M (printing surface) on which ink is discharged. Next, when the discharge operation ends, the imaging portion 52 images the nozzle surface 512 via the reflecting mirror 62 after the carriage 53 moves to the second position P2.

Then, in a case where deviation does not occur at the landing position of the ink droplets Id that are discharged on the medium M on the printing surface or in a case where foreign matter is not adhered in the vicinity of the nozzle 511, the subsequent discharge operation is performed without performing wiping of the discharge portion 51. That is, in the case where foreign matter is not adhered in the vicinity of the nozzle 511 or in the case where deviation does not occur at the landing position of the ink droplets Id on the printing surface, wiping of the nozzle surface 512 is not performed as there is no influence on printing quality even if printing is continued.

Meanwhile, in the case where foreign matter is adhered in the vicinity of the nozzle 511 and in a case where deviation occurs at the landing position of the ink droplets Id, wiping of the wiping portion 611 is performed. That is, in this case, when deficient discharge of ink by any nozzle 511 occurs and printing (the discharge operation) continues, wiping of the discharge portion 51 is performed as the printing quality is reduced.

In addition, in a case where printing is performed in the printing apparatus 10, air is blown toward a region in which the carriage 53 reciprocally moves in the scanning direction X, that is, the second guiding portion 32, the wiping mechanism 61, and the reflecting mirror 62 by driving the air blowing fan 72. Therefore, foreign matter that floats inside the casing 11 is suppressed from adhering to (accumulating on) the reflecting mirror 62, and foreign matter accumulated on the reflecting mirror 62 is suppressed from being mirrored in the image Img2 of the nozzle surface 512 that is imaged by the imaging portion 52.

According to the embodiment described above, it is possible to obtain the effects indicated below.

(1) The nozzle surface 512 comes to be in the first state of facing the medium M using the movement mechanism 55 in a case where the discharge portion 51 discharges ink towards the medium M. Meanwhile, the nozzle surface 512 comes to be in the second state of facing the imaging portion 52 via the reflecting mirror 62 using the movement mechanism 55 in a case where the imaging portion 52 images the nozzle surface 512 via the reflecting mirror 62. In this manner, since it is possible to switch a state of the nozzle between a state in which the discharge portion 51 discharges ink toward the medium M and a state in which the imaging portion 52 images the nozzle surface 512 via the reflecting mirror 62, the imaging portion 52 and the reflecting mirror 62 tend not to hinder discharge of ink by the discharge portion 51 when the discharge portion 51 discharges ink toward the medium M.

Then, it is possible to evaluate the state of the nozzle surface 512 based on the image Img2 of the nozzle surface 512 that is imaged by the imaging portion 52. Therefore, since it is possible to wipe the nozzle surface 512 only in a case where the nozzle surface 512 is soiled by mist and the like of ink, it is possible to suppress wiping of the nozzle surface 512 when it is not necessary to wipe the nozzle surface 512 of the discharge portion 51. Furthermore, it is possible to suppress deterioration over time of the ink repellent film of the nozzle surface 512, and lengthen life of the discharge portion 51.

(2) When foreign matter such as mist or fragments (paper powder) of the medium M that is generated when ink is discharged from the discharge portion 51 adheres to the reflecting mirror 62, it is not possible to accurately evaluate the state of the nozzle surface 512 since the imaging portion 52 images the nozzle surface 512 to which foreign matter is adhered. In this point, according to the embodiment, it is possible to suppress adherence of foreign matter as described above to the reflecting mirror 62 since the air blowing portion 70 blows air on the reflecting mirror 62. Accordingly, it is possible to accurately evaluate the state of the nozzle surface 512 since foreign matter is suppressed from being mirrored in the image Img2 of the nozzle surface 512 that is imaged by the imaging portion 52.

(3) In a case where the reflecting mirror 62 is the concave mirror, it is possible for the imaging portion 52 to image the nozzle surface 512 in further detail since it is possible to enlarge and mirror the nozzle surface 512. Therefore, it is possible to accurately evaluate according to the state of the nozzle surface 512. In addition, in a case where the reflecting mirror 62 is the convex mirror, it is possible to reduce the size of the reflecting mirror 62 since it is possible to mirror a wide range of the nozzle surface 512. Therefore, it is possible to reduce a region for disposing the reflecting mirror 62.

(4) It is possible to switch from the first state in which the nozzle surface 512 faces the medium M to the second state in which the nozzle surface 512 faces the imaging portion 52 via the reflecting mirror 62 by the carriage 53 being moved from the first end X1 to the second end X2 since the second guiding portion 32 and the reflecting mirror 62 are adjacently disposed in the scanning direction X. That is, it is possible to efficiently switch a state of the nozzle between the first state and the second state since switching between the first state and the second state is possible by only moving the carriage 53 in the scanning direction X.

(5) It is possible to more precisely determine whether or not wiping of the nozzle surface 512 is performed since it is possible to determine whether or not wiping of the nozzle surface 512 is performed based on the two determination results of the first determination based on the image Img1 of the printing surface and the second determination based on the image Img2 of the nozzle surface 512. In detail, it is possible to suppress unnecessary wiping of the nozzle surface 512 in comparison to determination of whether or not wiping of the nozzle surface 512 is performed based on any one determination result since wiping of the nozzle surface 512 is performed only in a case where the nozzle surface 512 is soiled and a case where deviation occurs at a landing position of the ink droplets Id that are discharged from the nozzle 511.

Here, the embodiment may be modified as shown below.

The wiping mechanism 61 may be disposed on one side of the second guiding portion 32 and the reflecting mirror 62 may be disposed on the other side of the second guiding portion 32.

The control portion 80 may calculate the amount of transport of the medium from the pattern of the medium M, wrinkles that are generated in the medium M, and the like and may determine whether or not deficient transport of the medium M occurs in a case where the first determination is performed based on the image Img1 of the printing surface.

The printing apparatus 10 may not be provided with the air blowing portion 70. In this case, preferably a film is formed on the front surface of the reflecting mirror 62 in order to suppress adherence of foreign matter.

The printing apparatus 10 may be provided with an adjustment mechanism that adjusts an angle of the discharge portion 51, the imaging portion 52, and the reflecting mirror 62. Thereby, it is possible to adjust an imaging location of the nozzle surface 512 in a case where the carriage 53 is positioned at the second position P2 and the imaging portion 52 images the nozzle surface 512. Note that, in this case, the adjustment mechanism is equivalent to an example of a "movement mechanism".

The reflecting mirror 62 may be embedded in the second guiding portion 32. Thereby, after printing is performed on a certain medium M and before printing starts on a subsequent medium M, that is, when the reflecting mirror 62 does not support the medium M, it is possible to image in the imaging portion 52 the nozzle surface 512 that is mirrored on the reflecting mirror 62 that is embedded in the second guiding portion 32. In addition, in the scanning direction X, it is not necessary to adjacently provide the second guiding portion 32 and the reflecting mirror 62 and it is possible to suppress an increase of size of the printing apparatus 10 in the scanning direction X due to the installation of the reflecting mirror 62.

The discharge portion 51 may be a line head that is fixedly disposed within the casing 11 and discharges ink in a region across the scanning direction X of the medium M. That is, the printing apparatus 10 may be a so-called line printer. In this case, preferably the imaging portion 52 is disposed such that the imaging direction faces the medium M further to the transport direction downstream side than the line head such that it is possible to image the printing surface of the medium M onto which the ink is discharged. In addition, preferably the reflecting mirror 62 has approximately the same length as the line head in the scanning direction X. Then, preferably the printing apparatus 10 is provided with a moving portion (an example of the movement mechanism) that moves the reflecting mirror 62 so as to switch a state of the nozzle between the first state in which the nozzle surface 512 of the line head faces the medium M and the second state in which the nozzle surface 512 faces the imaging portion 52 via the reflecting mirror 62.

The reflecting mirror 62 may be provided in the carriage 53. In this case, preferably a modifying portion (an example of the movement mechanism) is provided that switches between the first state and the second state by modifying the position and angle of the reflecting mirror 62.

The reflecting mirror 62 may mirror a part of the nozzle row 513 lined up in the scanning direction X and may mirror a part of the plurality of nozzles 511 that are set in a row in the transport direction F. That is, the length of the reflecting mirror 62 may be less than the length of the nozzle row 513 of the discharge portion 51 in the transport direction F.

The first determination may not be determined based on the image Img1 of the printing surface. That is, it may be determined whether or not the nozzle surface 512 is wiped using only the second determination based on the image Img2 of the nozzle surface 512. In addition, the imaging portion 52 may not be provided in the carriage 53 in a case where the first determination is not executed.

In a case where a nozzle 511 that tends to have deficient discharge is identified based on printing content or the like, the image Img2 of the nozzle surface 512 that includes at least the nozzle 511 may be imaged and the second determination may be performed. In addition, the image Img1 of the printing surface that includes the ink droplets Id that are discharged by the nozzle 511 that tends to have deficient discharge may be imaged and the first determination may be performed. Note that, for example, the nozzle 511 that tends to have deficient discharge may be a nozzle that discharges ink which includes a component that tends to thicken in comparison with ink of another color, a nozzle that has little chance to discharge ink in comparison with ink of another color, or the like.

Bidirectional printing may be performed in which ink is discharged from the discharge portion 51 in both cases of a case where the carriage 53 is moved in the scanning direction X from the first end X1 to the second end X2, and a case where the carriage 53 is moved in the scanning direction X from the second end X2 to the first end X1.

The air blowing portion 70 may not be provided. In this case, the air flow may hit a reflective surface of the reflecting mirror 62 by providing a suction portion that suctions air inside the casing 11. Thereby, it is possible to obtain an effect (2) of the embodiment. In this manner, the air blowing portion 70 may be an air flow generating portion that generates air flow that hits the reflective surface of the reflecting mirror 62.

Other than a paper sheet, the medium M may be textiles, leather, plastic, wood, or ceramics.

Other than the medium M that is unwound from the roll body R, the medium M may be a single-sheet like medium M or may be a simple long medium M.

The liquid droplets that are discharged or ejected by the discharge portion 51 is not limited to ink, and for example, may be a liquid body or the like in which particles of a functional material are dispersed or mixed in the liquid. For example, there may be a configuration in which recording is performed by discharging a liquid body including, in a dispersed or dissolved form, material such as an electrode material or color material (pixel material) which are used in manufacture and the like of a liquid crystal display, an electro-luminescence (EL) display, and a surface light emission display. That is, the printing apparatus 10 may be a liquid droplet discharge apparatus that discharges liquid droplets other than of ink.

This application claims priority under 35 U.S.C. § 119 to Japanese Patent Application No. 2016-156216, filed Aug. 9, 2016. The entire disclosure of Japanese Patent Application No. 2016-156216 is hereby incorporated herein by reference.

What is claimed is:

1. A liquid droplet discharge apparatus comprising:

a discharge portion that has a nozzle surface to which a nozzle that discharges liquid droplets on a medium is open;

a reflecting mirror that is positioned to reflect the nozzle surface and that reflects light;

an imaging portion that images the reflecting mirror to obtain a nozzle surface image;

a wiping portion that wipes the nozzle surface;

a movement mechanism that moves at least one out of the discharge portion, the reflecting mirror, and the imaging portion so as to switch a state of the nozzle between a first state in which the nozzle surface faces the medium and a second state in which the nozzle surface faces the imaging portion via the reflecting mirror;

a support portion that supports the medium onto which liquid droplets are discharged from the discharge portion; and a carriage that moves in a scanning direction in a state in which the discharge portion and the imaging portion are supported, wherein the support portion and the reflecting mirror are disposed lined up in the scanning direction, and the movement mechanism switches between the first state and the second state by moving the carriage in the scanning direction, wherein the nozzle surface image is obtained during a printing operation.

2. The liquid droplet discharge apparatus according to claim 1, further comprising:

an air blowing portion that blows air toward the reflecting mirror.

3. The liquid droplet discharge apparatus according to claim 1, wherein the reflecting mirror is a concave mirror or a convex mirror.

4. The liquid droplet discharge apparatus according to claim 1, wherein the imaging portion is supported in the carriage such that the imaging portion faces the support portion when the nozzle surface is in the first state, and a control portion is provided that determines whether or not wiping of the nozzle surface is performed based on an image of the nozzle surface that is obtained by imaging the nozzle surface via the reflecting mirror and an image of a liquid droplet discharge surface that is obtained by the imaging portion imaging the medium onto which liquid droplets are discharged.

* * * * *